United States Patent [19]

Hillebrand

[11] 4,419,977

[45] Dec. 13, 1983

[54] FUEL INJECTION SYSTEM AND TIMING ADVANCE DEVICE THEREFOR

[75] Inventor: George A. Hillebrand, Battle Creek, Mich.

[73] Assignee: Eaton Corporation, Cleveland, Ohio

[21] Appl. No.: 379,401

[22] Filed: May 18, 1982

Related U.S. Application Data

[63] Continuation of Ser. No. 23,122, Mar. 23, 1979, abandoned.

[51] Int. Cl.[3] ..... F02M 39/02; F02M 47/02

[52] U.S. Cl. ..... 123/502; 123/508; 123/90.12; 239/90; 239/95

[58] Field of Search ..... 123/502, 508, 90.12, 123/90.16, 90.17, 90.15, 90.46, 90.55, 90.63; 417/462, 293, 494, 499; 239/88-95, 533.1-533.12

[56] References Cited

U.S. PATENT DOCUMENTS

| | | | |
|---|---|---|---|
| 2,840,063 | 6/1958 | Porchas | 123/90.55 |
| 3,786,792 | 11/1974 | Pelizzoni | 123/90.16 |
| 3,859,973 | 1/1975 | Dreisin | 123/502 |
| 3,967,602 | 7/1976 | Brown | 123/90.55 |
| 4,164,917 | 8/1979 | Glasson | 123/90.17 |
| 4,249,499 | 2/1981 | Perr | 123/502 |

FOREIGN PATENT DOCUMENTS

| | | | |
|---|---|---|---|
| 2652154 | 5/1978 | Fed. Rep. of Germany | 123/90.46 |

OTHER PUBLICATIONS

S.A.E. Journal, Aug. 1942, "Some Results of Valve-Gear Research as Applied to Diesel Engines", Voorhies, Carl, pp. 358-371, in particular pp. 367-370 and FIG. 28.

*Primary Examiner*—Charles J. Myhre
*Assistant Examiner*—Carl Stuart Miller
*Attorney, Agent, or Firm*—C. H. Grace; R. A. Johnston; J. G. Lewis

[57] ABSTRACT

A hydraulic advance device for selectively transmitting applied forces to a fuel injector of an internal combustion engine. The device is operative to select a normal or advanced timing of the fuel injection. An outer cylindrical body (66) is mounted in the upper end of a fuel injector adapter. An inner body (108) is slidably received in an outer body and a pressure responsive plunger (104) is slidably received in a bore formed in the inner body and defines in cooperation therewith a fluid chamber (128). A one-way valve (132) in the chamber permits fluid above a predetermined pressure applied during the advanced stage of the fuel injection cycle to enter the chamber which prevents movement of the plunger relative to the inner body member. At pressures below a predetermined value and during the normal phase of the fuel injection cycle, the plunger first moves relative to the inner body a predetermined amount during which time no movement is transferred to the inner body thus delaying fuel injection relative to advance phase fuel injection.

7 Claims, 14 Drawing Figures

FUEL INJECTION SYSTEM AND TIMING ADVANCE DEVICE THEREFOR

This is a continuation of application Ser. No. 23,122, filed Mar. 23, 1979, now abandoned.

BACKGROUND OF THE INVENTION

The invention relates to fuel injection systems and a hydraulic advance device for a fuel injection system of an internal combustion engine for improving the performance of the engine and reducing exhaust gas contamination.

DESCRIPTION OF THE PRIOR ART

Fuel injection systems for engines, and particularly diesel engines, typically comprise an injection nozzle assembly actuated by advancing a nozzle plunger into a metered volume of fuel located in a metering chamber at the tip of the injection nozzle whereupon the fuel is forced through the nozzle and into the engine combustion chamber. The associated components for actuating the nozzle plunger are comparable to combustion chamber engine poppet valve gear systems and include a pushrod engaging a camshaft at one end and a rocker arm at the other end which in turn transmits cyclically applied forces to the injection nozzle at a precise stage during the engine compression cycle. Hydraulic advance devices are presently being used for selectively modifying the timing of the fuel injection event to alter engine performance and particularly for the purpose of reducing exhaust gas contamination levels at specific engine operating conditions. Such devices momentarily alter the effective length of the force transmitting members between the rocker arm and the injection nozzle plunger such that the tip of the injection plunger begins its downward movement into the fuel metering chamber at an advanced stage or earlier time relative to the engine compression cycle or engine main shaft rotation.

A known hydraulic advance system presently utilizes a device employing an upper and lower plunger member slidably received in a bore of a hollow cylindrical body member. A fluid passageway formed in the body member communicates a selectively applied high pressure fluid signal from a source in the engine to passageways in the upper plunger member. The high pressure fluid then flows past a one-way ball valve and into a fluid chamber formed between the upper and lower plunger members. As fluid enters the chamber, it moves the upper plunger to a position spaced from the lower plunger thereby increasing the effective length of the device between a reaction surface on the upper plunger and a reaction surface on the lower plunger. In the known devices it is required that the clearance between the outer diameters of the upper and lower plungers and the inner diameter of the outer body member be precisely held within tight tolerances along the entire length of the bore in the body member in order to maintain the fluid volume at a predetermined magnitude in the fluid chamber for fixing the spacing between the reaction surfaces or upper and lower plungers. The relatively large amount of plunger movement inherent in operation of the above described device makes it susceptible to wear and limited service life.

SUMMARY OF THE INVENTION

The present invention provides a device responsive to selective application of fluid under relatively high pressure from a source provided on the engine for altering the timing of fuel injection. The device is adapted to be inserted in the fuel injection drive system for receiving and transmitting injector drive motion and includes a hollow inner body member slidably received in an outer body member through which a fluid port means is provided to communicate fluid under pressure to the inner body member. A plunger member is slidably received within a bore in the inner body member and is biased outwardly therefrom by a compression spring toward a first position spaced from the bottom of the bore in the inner body and is movable between the first position to a second position in abutment with inner body member.

When it is desired to advance the timing of the fuel injection with respect to engine shaft rotation, a high pressure fluid signal is applied to the fluid passageway and the one-way ball valve opens in response thereto while the plunger is in the first position. Fluid then flows into the cavity until it is completely filled and the plunger moved to second position extending the effective length of the device. Upon release of the high pressure fluid at the inlet, the check valve closes retaining fluid in the cavity and maintaining the device at the extended effective length. A relief valve is mounted in the inner body member and remains closed throughout the advanced fuel injection stroke until the injector nozzle plunger bottoms-out in the nozzle metering chamber. Thereafter motion of the injector is prevented and continued application of force to the device causes the pressure in the cavity to exceed a predetermined value whereupon the relief valve opens permitting the fluid within the chamber to exhaust to the atmosphere which is accompanied by movement of the plunger to the second position in abutment with the inner body member.

During the normal operation of the fuel injection cycle the timing is not advanced by the device and no high pressure fluid signal is transmitted to the plunger. The volume of oil in the cavity beneath the plunger is at a level sufficient to permit the plunger to move downwardly from the first to the second position overcoming its biasing spring. During movement of the plunger from the first to the second position, the inner body is held stationary relative to the outer body by an injection plunger return spring which is stiffer than the plunger biasing spring. The plunger and inner body member thereafter move downwardly as a unit against the injection plunger, during which time fuel is injected into the combustion chamber. This motion of the plunger relative to the outer body member during both normal and advanced modes of engine operation reduces the axial distance the plunger moves relative to its cooperating sealing surface to approximately 33% of the movement experienced by a corresponding plunger in the above described prior art device.

It is therefore an object of the invention to provide a hydraulic advance device for a fuel injection system which has superior service life as compared to previous devices.

BRIEF DESCRIPTION OF THE DRAWINGS

FIG. 4 illustrates the positions of the invention and the injector plunger immediately preceding injection;

FIG. 5 illustrates the invention and injector plunger during the fuel injection stage;

FIG. 6 illustrates the invention and injector plunger upon completion of the fuel injection stage;

FIG. 7 shows the invention and injector plunger immediately after the initial recovery stage;

FIG. 8 shows the invention and the injector plunger in the fully recovered position;

FIG. 9 shows the positions of the invention device and the injector plunger at the onset of fuel injection;

FIG. 10 shows the positions of the invention device and the injector plunger as fuel injection continues;

FIG. 11 shows the positions of the invention and the injector plunger immediately after fuel injection has been completed with the oil pressure relief valve shown in the opened position;

FIG. 12 shows the positions of the invention device and the injector plunger immediately after oil pressure relief is completed;

FIG. 13 shows the invention device and the injector plunger after initial recovery.

DETAILED DESCRIPTION

Figure 1:
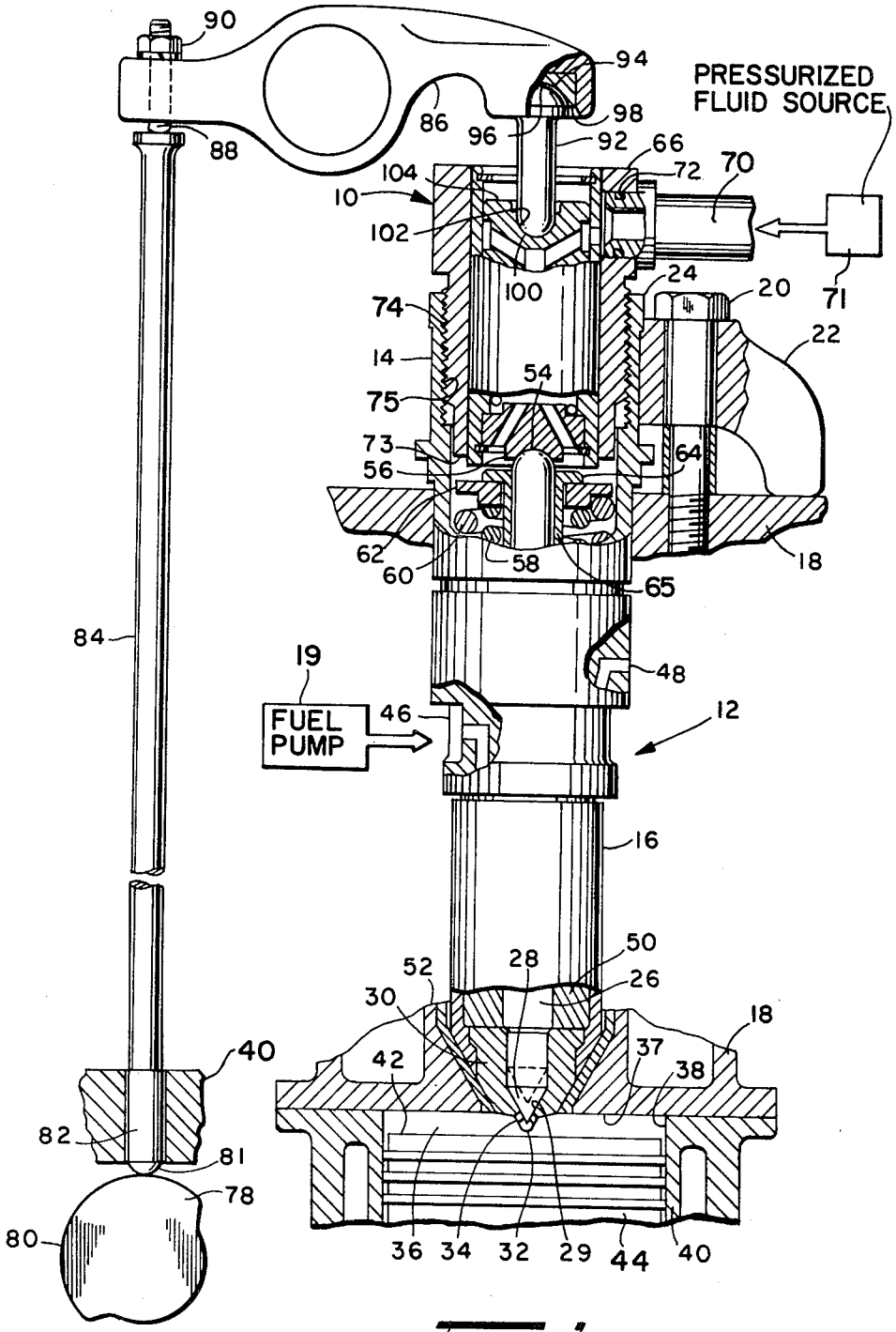
FIG. 1 is a view with portions thereof broken away of the invention mounted in the fuel injection system of an engine of the type having a nozzle and a cam driven pushrod rocker arm arrangement and adapted for selective injection timing advance.

Referring now to FIG. 1, a hydraulic advance device, indicated generally by reference numeral 10, is connected to a typical engine fuel injection drive train having a plunger type injector indicated generally by reference numeral 12. Fuel injector 12 includes an adapter portion 14 mounted in an engine cylinder head 18, partially shown in cross-section. In the presently preferred practice of the invention the advance device 10 is threadably received in the upper end of adapter 14. Advance device 10 could be mounted in alternate locations relative to the injector drive system, for example, in association with a rocker arm or in an engine block in association with a tappet. A fuel pump 19 is shown schematically and supplies a metered amount of fuel through entry port 46 from a supply of fuel, not shown. For flow through-type injectors, a fuel drain port 48 is provided. A bolt 20 is threadedly received in cylinder head 18 and reacts against a clamp member 22 which secures the adapter 14 to cylinder head 18. A locking nut 24 is threadedly received over and retains the advance device 10 axially positioned with respect to adapter 14.

Fuel injector 12 includes a body member 16 housing an injector plunger 26 having a tapered end portion 28 conformable with ends sealingly engageable with a corresponding tapered surface 29 of an injector cup 30. A tip portion 32 of injector cup 30 has formed therein a plurality of nozzle exhaust orifices 34. Nozzle orifices 34 and tip portion 32 extend into the engine combustion chamber 36 defined by a bottom surface 37 of cylinder head 18, a cylindrical wall 38 of an engine block 40, and an upper surface 42 of an engine piston 44 received in cylinder 38. A cylindrical barrel section 50 of the injector 12 within body 16 is in abutment with the lower end of adapter 14. A tubular retainer 52 is received over injector cup 30 and barrel 50 and is threadedly connected (not shown) to the lower end of adapter 14. A system of check valves and fluid supply passageways, not shown, are disposed and formed in adapter 14 and barrel section 50 and cooperate with valving surfaces on the plunger, also not shown. When the injector plunger 26 is retracted to the position shown by the dashed lines of FIG. 1, a metered amount of fuel is supplied by the fuel pump 19 through entry port 46 and the passageways in adapter 14 and barrel section 50 where it then flows into the space between the plunger tapered end 28 and surface 29. The system of fluid passageways, check valves, and valving surfaces on the plunger may be any suitable arrangement known in the art and appropriate for the particular engine application.

A connecting rod 54 has its lower end in contact with the upper end (not shown) of injector plunger 26 and its upper end in contact with a lower reaction member 56 of advance device 10. Return springs 58 and 60 are received in adapter 14 and react against a retaining washer 62 which in turn abuts against a flanged portion 64 of a tubular connector 65 which has the lower end thereof (not shown) connected to the upper end of injector plunger 26.

An outer body member 66 of advance device 10 has a bore 67 formed therethrough and a transversely extending fluid port 68 formed through the upper wall thereof. A high pressure oil supply line 70 is connected to the outer body 66 at port 68 and functions to transfer a pressurized fluid signal from a pressurized source 71 shown schematically by FIG. 1. A sealing ring 72 is mounted in a groove formed in the wall of line 70 and sealingly engages fluid port 68.

Upward travel of washer 62 as moved by springs 58 and 60 is limited by abutment against the lower end surface of outer body 66 designated as stop 73. An externally threaded section 74 on outer body 66 engages with a corresponding internally threaded section 75 of adapter 14 and permits the position of stop 73 to be axially adjusted relative to fuel injector 12.

Timed vertical movement is imparted to injector plunger 26 through an intermediate tappet rocker arm and pushrod by rotation of a cam 78 mounted on a camshaft, not shown, which is driven by the engine. Cam 78 has a profile 80 engageable with a follower 81 located on the end of a tappet or cam follower 82 guided for movement in a bore in the engine block 40. A pushrod 84 has its lower end connected to tappet 82. A rocker arm 86 is pivotally mounted relative to engine cylinder head 18 and has received through one end thereof an adjusting screw 88 having a lower end in contact with the upper end of pushrod 84. A locknut 90 axially retains the adjusting screw 88 relative to rocker arm 86. A linking rod 92 is provided between the rocker arm 86 and the device 10 and has an upper spherical end 94 reacting against a corresponding spherical surface 96 formed in a rocker arm socket member 98. Linking rod 92 has a lower spherical end 100 reacting against a corresponding spherical surface 102 formed on the upper end of a cylindrical plunger 104 of advance device 10. Plunger 104 will be described subsequently in greater detail with reference to device 10.

Figure 2:
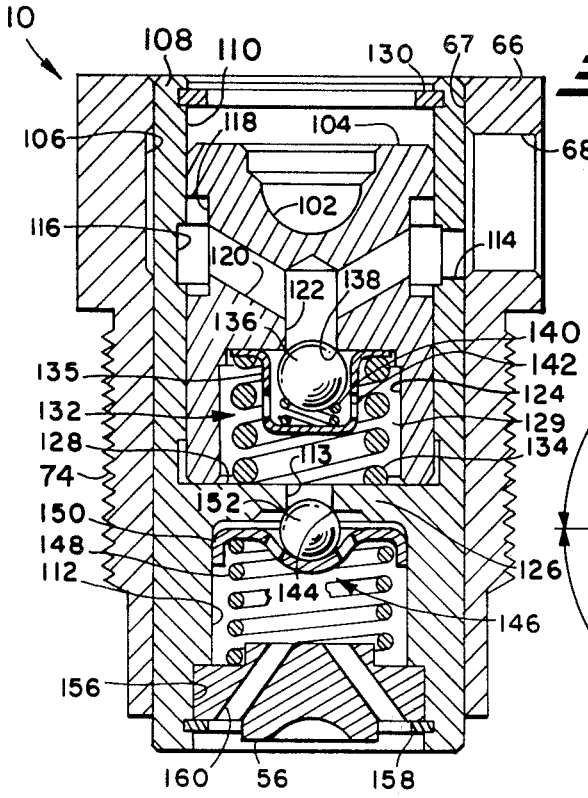
FIG. 2 is an enlarged cross-sectional view of the invention hydraulic advance device removed from the engine fuel injection system of FIG. 1.

Referring now to FIG. 2, the hydraulic advance device 10 is shown in an enlarged cross-sectional view, the outer body member 66 includes an inner circumferential oil receiving groove 106 axially aligned with fluid port 68. An inner body member 108 is slidably received within outer body 66 and defines a first bore 110 through one end and a second bore 112 formed in the other end. A transverse fluid passageway 114 extends through the wall of inner body member 108 and is generally axially aligned with circumferential oil groove 106. An internal, circumferential oil receiving groove 116 is axially aligned with oil passageway 114 and is formed in the wall of bore 110 of inner body 108. An external, circumferential oil receiving groove 118 is formed on the outer diameter of plunger 104 adjacent its upper end and extends longitudinally downwardly in FIG. 2 such that portions of grooves 116 and 118 overlap during reciprocal vertical motion of plunger 104 relative to inner body member 108.

Radial passageways 120 extend inwardly through plunger 104 and communicate with a centrally located axial fluid passageway 122. Passageway 122 extends into a bore 124 formed in the lower end of plunger 104. Bore 110 and bore 112 are interconnected by a vertical passage 113 in area of reduced diameter 126 in inner body 108. A bottom surface 128 of bore 110 forms, in cooperation with plunger bore 124, a fluid chamber 129 which has a minimum volume, as shown by FIG. 2, when the lower end of the plunger 104 is in abutment with surface 128. A suitable retaining means is employed, as for example, ring 130, and is received in a groove formed into bore 110 and adjacent the upper end of inner body member 108 and functions to axially retain plunger 104 within bore 110 prior to insertion of device 10 in adapter 14. Downward movement of the plunger 104 is limited by abutment with surface 128 wherein the volume of fluid chamber 129 is at a minimum. It will be understood that the clearance between the outer diameter of plunger 104 and bore 110 of inner body member 108 must be controlled within specified tolerances as known in the art in order to permit free reciprocal movement of the plunger 104 relative to inner body 108 and yet to prevent undesired leakage of high pressure oil contained within fluid chamber 129.

A one-way ball valve assembly, indicated generally at 132, is received in fluid chamber 129 and is axially retained against the transverse wall of plunger 104 by a compression-type biasing spring 134 which has its lower end racting against surface 128 and its upper end reacting against a retaining cage 135 received over one-way valve assembly 132. Valve assembly 132 includes a ball 136 which is maintained in sealing contact against a corresponding annular valve seat 138 formed on the edge of the opening of passageway 122 into bore 124. A biasing spring 140 has its lower end seated against retaining cage 135 and its upper end reacting against ball 136 for biasing the ball to the closed p;osition against seat 138.

Openings 142 are stamped into cage 135 and permit fluid flow therethrough upon ball 136 being spaced from valve seat 138. The force of biasing spring 140 exerted on ball 136 divided by the cross-sectional area across valve seat 138 determines the fluid pressure at which valve 132 opens for permitting fluid flow into chamber 129 when the cam 80 (FIG. 1) is in a position such that linking rod 92 is not pushing against the device 10. Biasing spring 134 functions to move the plunger 104 upwardly toward retaining ring 130. The force of biasing spring 134 is sufficient to overcome the atmospheric pressure acting on the transverse area of plunger 104 as it moves outwardly from the second to the first position. The function and operation of one-way valve 132, biasing spring 134 and plunger 104 as it relates to the fuel injection cycle will be described subsequently in greater detail.

An annular valve seat 144 is formed around passage 113 as it intersects the bottom surface of bore 112. A relief valve, indicated generally by reference numeral 146, is disposed in bore 112 and includes a biasing spring 148 acting against a cage member 150 received over and which in turn applies a seating force against a ball valve member 152. Ball 152 is seated against valve seat 144 and biased thereagainst to the closed position by spring 148. Relief valve 146, which functions as one-way valve 132, will remain closed until fluid pressures within fluid chamber 129 exceed a predetermined value sufficient to overcome the force of biasing spring 148. In the presently preferred practice, the relief valve 146 is set to open at fluid pressures on the order of $1.03\times10^4$ Kpa (15,000 pounds per square inch).

Valve 146 is retained in bore 112 by lower reaction member 56 located in a counterbore 156 against which the lower end of spring 148 reacts. Upward movement of member 56 is limited by abutment against the bottom of counterbore 156. A retaining ring 158 is mounted in an internal groove provided in counterbore 156 and functions to axially retain reaction member 56 relative to inner body 108. Fluid passage is provided through lower reaction member 56 preferably in the form of a plurality of diverging ports 160 to permit fluid flowing past relief valve 146 from fluid chamber 129 to escape by gravity flow to the atmosphere.

Figure 4:
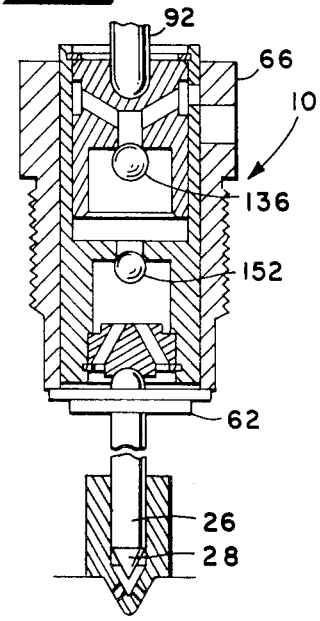
FIGS. 4 through 8 illustrate the relative positions of the injector plunger and the invention hydraulic advance device during engine operation with normal injector timing.

With continued reference to FIG. 2, the internal operation of the advance device 10 will first be discussed as it responds only to the presence or absence of a high pressure fluid signal, about $1.38\times10^2$ Kpa (20 pounds per square inch), introduced through fluid port 68 from source 71. During normal or unadvanced injector timing operation, no high pressure fluid signal is communicated through fluid port 68. Biasing spring 134 is then effective to move the plunger 104 outwardly from surface 128 to its first position as shown by FIG. 4. With no high pressure fluid signal at port 68, any downward forces applied to the top of plunger 104 through spherical surface 102 in excess of the biasing force of spring 134 will be sufficient to move the plunger downwardly into its second position in abutment with surface 128.

During normal injector timing as defined above, reciprocal motion of plunger 104 relative to inner body member 108 is effected with the one-way ball valve 132 remaining in the closed position, thereby preventing any fluid from entering chamber 129. Relief valve 146 also remains closed during normal injector timing operation thereby substantially fluidly isolating chamber 129. It will be understood, however, that inner body member 108 is free at all times to move relative to bore 67 in outer body member 66.

During the advanced injection or timing operation, a high pressure fluid signal is communicated to fluid port 68 from source 71. The high pressure fluid then flows into the annular space between the outer diameter of inner body 108, oil receiving groove 106, fluid port 114, oil receiving groove 116, collector groove 118, radial passages 120, and into central passageway 122. Upon the high pressure fluid reaching passageway 122, one-way valve 132 opens and high pressure fluid fills chamber 129 with oil while plunger 104 remains in the upward, first position as shown in FIG. 4. Any downward force which is then applied to plunger 104 will be transmitted to the inner body member 108 unless the applied force is of sufficient magnitude to generate a fluid pressure in excess of about $1.03\times10^4$ Kpa (1500 pounds per square inch) within chamber 129 which opens relief valve 146 and permits fluid contained in chamber 129 to escape to the atmosphere. At pressures below that necessary to open relief valve 146, the fluid trapped within chamber 129 functions to substantially transform plunger 104 and inner body member 108 into a rigid one-piece link between surface 102 and reaction member 56.

Figure 3:
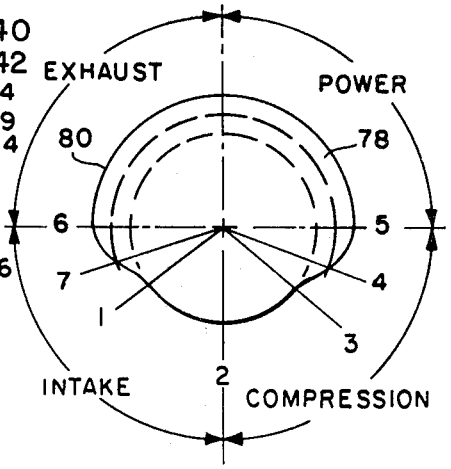
FIG. 3 is an enlarged view of an injector camshaft lobe of the system of FIG. 1 with portions of the periphery thereof designated in relation to engine power cycle operation.

Referring now to FIG. 3, the cam profile 80 of cam 78 is illustrated in greater detail with reference numerals 1 through 7 representing various positions on the cam profile which will subsequently be related to the operation of the advance device 10 for normal timing and advanced timing of fuel injection.

Figure 5:
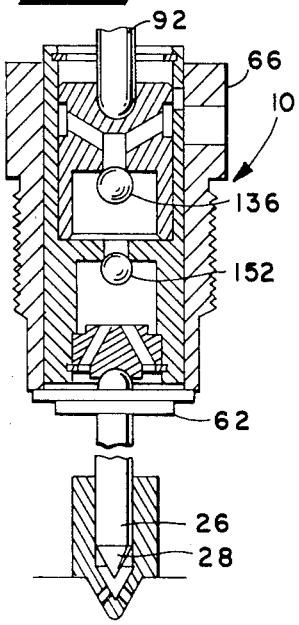

The operation of the hydraulic advance device in a fuel injection system will now be described for normally timed fuel injection during which no high pressure fluid signal is delivered to fluid port 68 from pressurized source 71. For this description, the reader's attention is directed to FIGS. 4–8 which schematically represent the positions of the advance device 10 relative to the injector plunger 26 and injector cup 30. Reference will be made to FIGS. 1 and 3 for describing cam movement relative to advance device 10. The first stage of a normally timed fuel injection cycle is represented by FIG. 4 which shows the plunger 104 moved to its first position in which it is spaced from surface 128 and in abutment with retaining ring 130. With reference to FIG. 4, the device 10 is illustrated in a position wherein injector springs 58, 60 have moved inner body member 108 upwardly until washer 62 (see FIG. 1) abuts stop 73. With device 10 in the condition shown in FIG. 4, the tip of injector plunger 26 (see FIG. 1) is spaced from tapered surface 29 its maximum amount and a metered volume of fuel has been transferred by fuel pump 19 to the volume between the injector cup and the injector plunger tip. Movement of cam 78 will hereinafter be described as profile 80 engages follower 81. Cam follower 81 will then be engaging cam profile 80 at position 1, as designated by FIG. 3. During rotation of cam 78 clockwise from position 1, through position 2 midway between the intake and compression cycle and to position 3, pushrod 84 remains stationary and device 10 is positioned as shown by FIG. 4. Continued clockwise rotation of cam 78 from position 3 to position 4 causes pushrod 84 to lift upwardly, rotating rocker arm 86 thereby causing downward movement of linking rod 92 which displaces plunger 104 downward into abutment with surface 128 of inner body member 108, as shown by FIG. 5. During this movement of plunger 104, inner body 108 remains stationary since the combined stiffness of injector springs 58, 60 is greater than the stiffness of biasing spring 134. The injector plunger 26 has thus far remained stationary.

Figure 6:
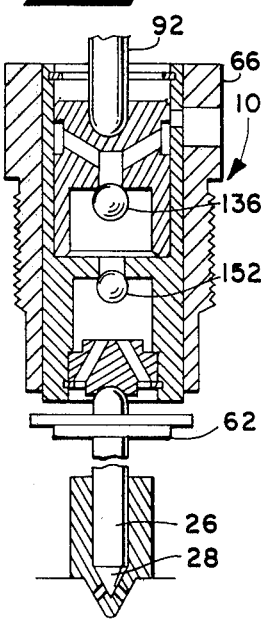

Subsequently, as the fuel injection cycle continues, further rotation of cam 78 from position 4 to position 5 causes linking rod 92 to move plunger 104 and inner body 108 downward as a unit, overcoming resisting force of the injector springs 58 and 60 and thereby moving injector plunger 26 downwardly into abutment against tapered surface 29 as shown by FIG. 6. Fuel is injected through nozzle orifices 32 into combustion chamber 36 during downward movement of plunger 26. As the injection cycle continues and cam 78 rotates from position 5 to position 6, injector plunger 26 remains bottomed out in injector cup 30. Further cam rotation from position 6 to position 7 permits injector plunger 26 to retract upwardly from the injector cup under the action of springs 58, 60. Washer 62 registers against stop 73 as shown as shown by FIG. 7.

Figure 7:
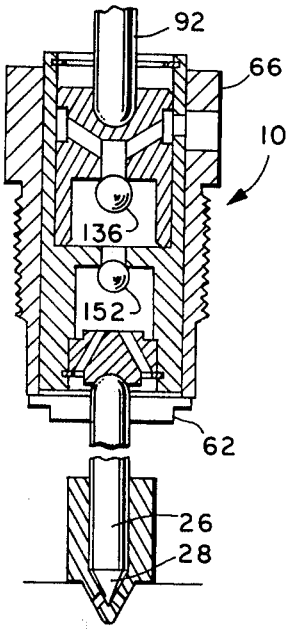
Figure 8:
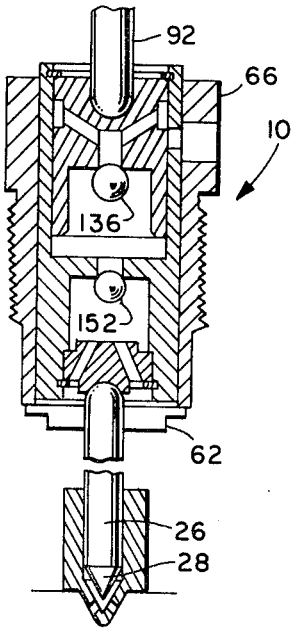

In the FIG. 7 position the lower surface of plunger 104 remains in abutment with surface 128. During subsequent cam movement from position 7 to position 1 biasing spring 134 lifts the plunger 104 upwardly to its first position spaced from bottom surface 128 and one cycle of normally timed injection is completed as shown by FIG. 8. The advance device 10 has returned to its fully extended position, ready for a repetition of the cycle starting at FIG. 4. During normally timed fuel injection operation, valves 132 and 146 remain closed.

Figure 9:
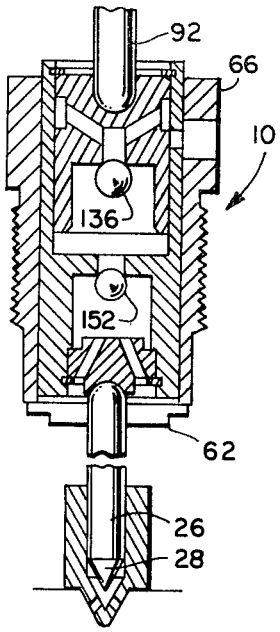
FIGS. 9 through 13 illustrate the relative positions of the injector plunger and the invention hydraulic advance device during the selectively advanced mode of fuel injection.
Figure 10:
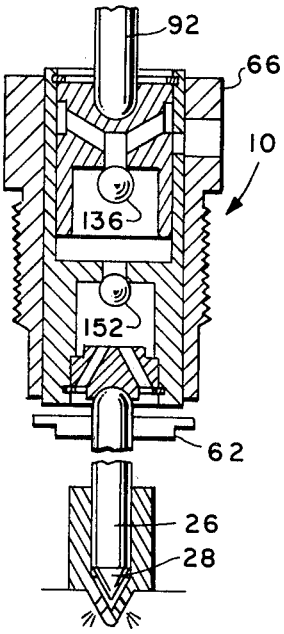

The operation of the hydraulic advance device 10 in a fuel injection system will now be described for selectively advanced timing of fuel injection, as illustrated schematically by FIGS. 9–14. Immediately prior to the position shown by FIG. 9 high pressure fluid is supplied from pressurized source 71 through fluid port 68 and into fluid chamber 129 in the manner described above. FIG. 9 also shows the inner body 108 moved upwardly with respect to the outer body 66 with washer 62 (see FIG. 1) in abutment against the stop 73. Injector plunger 26 is also fully retracted and a metered volume of fuel from fuel pump 19 is present in injector cup 30. For the FIG. 9 position of the device 10, cam follower 81 is engaging cam profile 80 at position 1, as shown by FIG. 3. Continued clockwise rotation of cam 78 causes cam follower 81 to move past positions 2 and 3 and then upwardly along the cam profile to position 4. Downward motion is caused through rocker arm 86 to linking rod 92 which moves plunger 104 downward. The lower surface of plunger 104 acts against the fluid trapped in chamber 129 thereby moving the inner body downward resulting in downward motion of injector plunger 26 during which fuel injection occurs, as illustrated by FIG. 10. FIG. 10 corresponds to a cam position intermediate positions 3 and 4. In contrast and as pointed out above, during normally timed fuel injection operation comparable cam movement from position 1 to position 4 did not result in fuel injection since plunger 104 moved downward relative to the inner body member without transmitting motion to the injector plunger. In the presently preferred practice the central angular distance on the cam from position 3 to position 4 is approximately ten degrees and represents the advance of the fuel injection event in terms of camshaft angular displacement as compared to normally timed injection.

Figure 11:
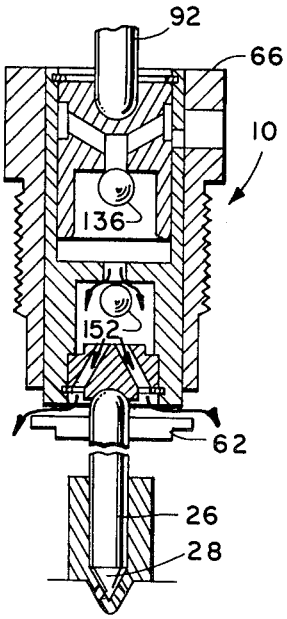
Figure 12:
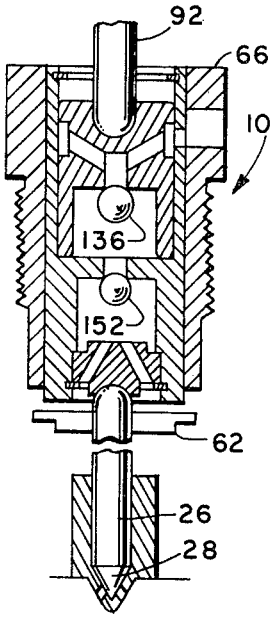

FIG. 11 shows the injector plunger tip "bottomed out" in the injector cup and fuel injection completed. Subsequent cam rotation from position 4 to position 5 causes an increased reaction force to be transmitted to the plunger 104 resulting in a rapid increase in fluid pressure within chamber 129. When the pressure within chamber 129 exceeds predetermined value given above, relief valve 146 opens permitting fluid contained within chamber 129 to escape to the atmosphere. The escaping fluid follows the path as indicated by the arrows in FIG.

Figure 13:
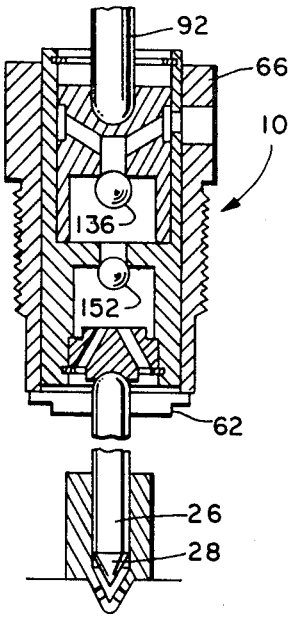
Figure 14:
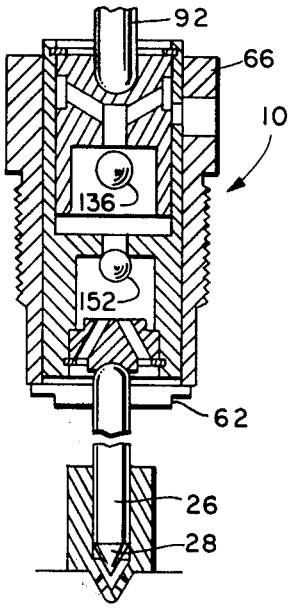
FIG. 14 shows the invention device and the injector plunger in the fully recovered position.

11. The injector plunger and advance unit 10 remain in the position shown by FIG. 12 as the cam rotates from position 5 to 6. Continued rotation of the cam profile relative to the cam follower from position 6 to position 7 permits plunger 104 and inner body member 108 to move upwardly together by the force of injector springs 58 and 60 until washer 62 abuts stop 73, as shown by FIG. 13. In FIG. 13, the injector plunger 26 is now fully retracted from the tapered surface in the injector cup. Further rotation of cam 78 from position 7 to position 1 permits biasing spring 134 to move plunger 104 upwardly to the first position. Plunger 104 is now ready to receive another high pressure fluid signal from pressurized source 71 for refilling chamber 129 with pressurized oil. Continued cycling of the engine with the selectively advanced timing of fuel injection will proceed again through the cycle described above and shown by FIGS. 9–14.

Further modifications and variations will be apparent to those having ordinary skill in the art and the invention is limited only by the following claims.

What is claimed is:

1. A hydraulic device for selectively varying the force transmitting length of a member used in an internal combustion engine of the type having a train of members cyclically moved in timed relationship to the engine power shaft for effecting combustion, said hydraulic device comprising:

(a) housing means adapted for adjustable mounting in an engine, and defining a hollow therethrough, said housing means including means defining a fluid port adapted for receiving pressurized fluid from a selectively activated source and operative to communicate the fluid to said hollow;

(b) unitary body means movably received in said hollow, said body means defining:

(i) first and second spaced cavities and a first fluid passage interconnecting said cavities said first cavity having the wall thereof extending a portion of the length of said body means, (ii) a second fluid passage operative to communicate said first cavity with said fluid port;

(c) plunger means received in said first cavity and movable therein between a first and second position, said plunger means defining a third fluid passage operative to communicate with said second fluid passage, said plunger means cooperating with said first cavity wall to define a controlled leak-down clearance therebetween and an expansible fluid chamber, said leak-down clearance fluidically interconnecting said fluid chamber and said third fluid passage, said plunger means including one-way valve means operative upon introduction of said pressurized fluid into said third passage to communicate said pressurized fluid to said chamber for causing expansion of said chamber and movement of said plunger means relative to said body means;

(d) means biasing said plunger means in a direction for expanding said chamber;

(e) said body means further including means defining a reaction surface adapted for contacting an engine member in a train and operative, upon application of a force to said plunger means, to transmit said force to said engine member; and, (f) pressure relief means operative to permit fluid above a predetermined pressure to flow from said chamber and exhaust to the atmosphere, wherein said plunger is operative in said first position to give said hydraulic device a first force transmitting length for effecting force transmission in a train of members and upon selective introduction of fluid at a predetermined pressure into said port means, said one-way valve permits fluid to flow to said chamber causing said plunger means to move to a position enlarging said chamber, whereupon said hydraulic device has a second force transmitting length for selectively effecting the motion of said train of members.

2. A hydraulic advance means for a fuel injection system of an internal combustion engine, comprising:

(a) outer body means mountable in said engine, said outer body means including port means adapted for receiving and communicating fluid under pressure from said engine to said outer body means;

(b) unitary inner body means slidably received in said outer body means, said inner body means including means defining a first passageway for fluidly connecting said port means and said inner body means;

(c) plunger means slidably received in said inner body means said plunger means including, (i) means defining a first reaction surface adapted to contact a first engine fuel injection system component;

(ii) means defining in cooperation with said inner body means a fluid chamber said plunger means cooperating to define a controlled leak-down clearance extending intermediate said first passageway and said fluid chamber, said plunger means being movable relative to said inner body means between a first position in which said fluid chamber volume is a minimum and a second position in which said fluid chamber volume is a maximum;

(iii) means for fluidly communicating said fluid chamber with said port means and for receiving fluid from said leak-down clearance;

(iv) one-way valve means for permitting fluid flow into said fluid chamber in response to engine fluid pressures above a predetermined minimum value; and, (d) means for biasing said plunger means toward said second position;

(e) said inner body means further including, (i) means defining a reaction surface on the end distal said first reaction surface for engaging a second fuel injection system component; and (ii) pressure relief means operative to permit fluid above a predetermined pressure to flow from said fluid chamber to the atmosphere, said advance means having a first effective force transmitting length while said plunger is in said first position and a second effective force transmitting length while said plunger is in said second position with said fluid chamber filled with fluid below said predetermined pressure.

3. A hydraulic device for selectively advancing the timing of fuel injection of an internal combustion engine, comprising:

(a) outer body means adapted for mounting in said engine and having a bore therethrough, said outer body means including means defining a fluid port adapted for receiving fluid under pressure from said engine and operative to communicate such fluid to said bore;

(b) unitary inner body means slidably received in said outer body means bore, said inner body means having a first bore formed in one end and extending a portion of the length thereof and a second bore formed in the other end thereof, said inner body means including, (i) means defining a first passageway connecting said port means and said first bore, and (ii) means defining a pressure relief passageway connecting said first bore and said second bore;

(c) plunger means slidably received in said first bore of said inner body means and defining a controlled leak-down clearance therebetween said leak-down clearance being extending intermediate said first passageway and the bottom of said first bore, said plunger means including, (i) means defining a reaction surface adapted to contact a driving engine fuel injection system component;

(ii) means defining in cooperation with said first bore a fluid chamber, said plunger means being movable relative to said inner body means in said first bore between a first position in which said fluid chamber volume is a minimum and a second position in which said fluid chamber volume is a maximum;

(iii) means defining a second fluid passageway for fluidly communicating said fluid chamber with said port means and for receiving fluid from said leak-down clearance, (iv) one-way valve means disposed in said fluid chamber for permitting fluid flow therein through said second passageway means in response to engine fluid pressures above a predetermined minimum valve; and, (d) means for biasing said plunger means toward said second position, (e) said inner body means further including, (i) means defining a reaction surface on the end distal said second bore for engaging a second fuel injection system component; and (ii) pressure relief means operative to permit fluid above a predetermined pressure to flow from said fluid chamber through said pressure relief passageway to the atmosphere, wherein said plunger means is operative in said first position to give said hydraulic device a first force transmitting length for effecting normal timing of engine fuel injection and, upon selective introduction of fluid at a predetermined pressure into said port means, said one-way valve means permits said fluid to flow to said fluid chamber causing said plunger means to move to said second position whereupon said hydraulic device has a second force transmitting length for selectively effecting advanced timing of engine fuel injection.

4. A system for injecting fuel into a combustion chamber of an internal combustion engine, said system comprising:

(a) drive means having a member cyclically moved in timed relationship to the events of the engine combustion cycle;

(b) injector means including means defining a fuel chamber having an injection port communicating with said combustion chamber and plunger means movable with respect to said fuel chamber for injecting a predetermined amount of fuel through said port into said combustion chamber;

(c) pump means operative upon connection to a supply of fuel to supply fuel to said fuel chamber;

(d) plunger actuating means operative in response to said drive means to move said plunger means in said fuel chamber for injecting fuel in said combustion chamber at a first predetermined time relative to the engine cycle; and, (e) means operable upon selective actuation for supplying a pressurized fluid signal for altering engine operation;

(f) said drive means further including advancing means for receiving said pressurized fluid signal and operable in response thereto for varying the timing of said actuating means to a second predetermined time relative to the engine cycle, said advancing means including, (i) housing means adapted for adjustable mounting in said engine and defining a hollow therethrough, said housing means including means defining a fluid port adapted for receiving said pressurized fluid signal from said supply means and operative to communicate the fluid signal to said hollow, (ii) unitary body means movably received in said hollow, said body means defining first and second cavities and a first fluid passage interconnecting said cavities, and a second fluid passage operative to communicate said first cavity with said fluid port, said first cavity having the wall thereof extending a portion of the length of said body means, (iii) plunger means movably received in said first cavity and movable therein between a first and second position, said plunger means defining a third fluid passage operative to communicate with said first cavity, said plunger means cooperating with the wall thereof to define a controlled leak-down clearance therebetween and an expansible fluid chamber, said leak-down clearance fluidically interconnecting said fluid chamber and said third fluid passage and extending intermediate said second passage and the bottom of said first cavity, said plunger means defining a reaction surface means engagable with said actuating means, said plunger means including one-way valve means operative to communicate said pressurized fluid signal from said third passage to said chamber for causing expansion of said chamber and movement of said plunger means relative to said body means, (iv) means biasing said plunger means in a direction for expanding said chamber, (v) said body means further including means defining a reaction surface adapted for contacting an engine member in said train of members and operative, upon application of the force to said plunger means, to transmit said force to said engine members, and (vi) pressure relief means operative to permit fluid above a predetermined pressure to flow from said chamber and exhaust to the atmosphere, wherein said plunger is operative in said first position to give said hydraulic device a first force transmitting length for effecting force transmission in said train of members and, upon said selective introduction of said fluid at a predetermined pressure into said port means, said one-way valve permits fluid to flow to said chamber causing said plunger means to move to a position enlarging said chamber, whereupon said hydraulic device has a second force transmitting length for selectively effecting the motion of said train of members.

5. The device defined in claim 4, further comprising means for retaining said plunger means in said first cavity.

6. The device defined in claim 1, wherein said housing means, said body means and said plunger means each have an elongated hollow cylindrical configuration.

7. The device as defined in claim 2, wherein said port means in said outer body means includes, (a) a transversely extending passageway through the wall of said outer body means; and (b) a circumferentially extending groove formed into the wall of said outer body means, said circumferential groove being axially aligned with said transverse passageway.

* * * * *